US005683956A

United States Patent [19]

Bowman et al.

[11] Patent Number: 5,683,956

[45] Date of Patent: Nov. 4, 1997

[54] THERMAL DYE TRANSFER SYSTEM WITH RECEIVER CONTAINING AMINO GROUPS

[75] Inventors: Wayne A. Bowman, Walworth; Steven Evans; Kristine B. Lawrence, both of Rochester, all of N.Y.

[73] Assignee: Eastman Kodak Company, Rochester, N.Y.

[21] Appl. No.: 633,385

[22] Filed: Apr. 16, 1996

Related U.S. Application Data

[60] Provisional application No. 60/002,977, Aug. 30, 1995.

[51] Int. Cl. [6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 4,614,521 9/1986 Niwa et al. ..... 8/471

FOREIGN PATENT DOCUMENTS 5-212981 8/1993 Japan ..... 503/227

*Primary Examiner*—Bruce H. Hess

*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye having a reactive carbonyl group, and (b) a dye-receiving element comprising a support having thereon a dye image-receiving layer, the dye-receiving element being in a superposed relationship with the dye-donor element so that the dye layer is in contact with the dye image-receiving layer, the dye image-receiving layer comprising a polymer containing a primary or secondary aliphatic amino group.

12 Claims, No Drawings

THERMAL DYE TRANSFER SYSTEM WITH RECEIVER CONTAINING AMINO GROUPS

CROSS REFERENCE TO RELATED APPLICATION

Reference is made to and priority claimed from U.S. Provisional application Ser. No. U.S. 60/002,977, filed 30 Aug. 1995, now abandoned, entitled THERMAL DYE TRANSFER SYSTEM WITH RECEIVER CONTAINING AMINO GROUP.

This invention relates to a thermal dye transfer system, and more particularly to the use of a thermal dye transfer assemblage wherein the receiver layer polymer contains reactive amino groups which react with carbonyl-substituted dyes transferred from a dye-donor element.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints and plastic folders, generally referred to as retransfer.

Many of the deficiencies of thermal dye transfer systems with regard to the above features can be traced to insufficient immobilization of the dye in the receiver polymer. It would be desirable to provide a dye/receiver polymer system in which the dye is capable of undergoing reaction with the receiver polymer to form a dye species with reduced mobility, preferably via covalent attachment to the polymer chain.

U.S. Pat. No. 4,614,521 relates to a reactive dye-polymer system for thermal dye transfer imaging. Specifically, this patent discloses a variety of dyes having substituents capable of reacting with receiver polymers having epoxy or isocyanate groups. However, there is a problem with receivers containing epoxy- or isocyanate-containing polymers in that they are potentially prone to poor keeping, especially in humid environments.

It is an object of this invention to provide a thermal dye transfer system having improved retransfer properties as compared to the prior art.

This and other objects are achieved in accordance with this invention which relates to a thermal dye transfer assemblage comprising:

(a) a dye-donor element comprising a support having thereon a dye layer comprising a dye dispersed in a polymeric binder, the dye having a reactive carbonyl group, and (b) a dye-receiving element comprising a support having thereon a dye image-receiving layer, the dye-receiving element being in a superposed relationship with the dye-donor element so that the dye layer is in contact with the dye image-receiving layer, the dye image-receiving layer comprising a polymer containing primary or secondary aliphatic amino groups.

It has been found that dyes substituted with reactive carbonyl groups give much better retransfer performance than do dyes without such substituents when transferred to receiving elements based on polymers containing reactive amino groups.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together and having the reactive primary or secondary amine group in any or all of the segments such as a poly(dimethylsiloxane)-polyacrylate block copolymer with the reactive groups located in the acrylate block, the poly(dimethylsiloxane) block or in both segments, etc.

In a preferred embodiment of the invention, the dyes employed in the invention have the general formulae:

$$A-L^1-OCO_2R^1 \quad \text{I}$$

$$A-L^2-COCH_2COYR^4 \quad \text{II}$$

$$A-L^2-YCOCH_2COR^4 \quad \text{III}$$

wherein:

A represents a thermally transferable dye residue, e.g., any of the dye classes described in the art for use in thermal transfer imaging such as azo, methine, merocyanine, indoaniline, anthraquinone, etc.;

$L^1$ represents a divalent alkylene linking group of 1–10 carbon atoms, which may be substituted or interrupted with other divalent moieties such as oxygen atoms, carbonyl groups, etc;

$L^2$ represents a divalent alkylene linking group of 1–10 carbon atoms, which may be substituted or interrupted with other divalent moieties such as oxygen atoms, carbonyl groups etc., or an optionally substituted divalent arylene linking group of 6–10 atoms;

$R^1$ represents an optionally substituted aryl group of 6–10 carbons or an optionally substituted hetaryl group of 5–10 atoms, such as pyridyl, furyl, thienyl, quinolyl, etc;

$R^1$ may optionally be bonded to either A or $L^1$;

Y represents a direct bond, O or $NR^5$;

$R^4$ represents optionally substituted alkyl of 1–10 carbons, optionally substituted aryl of 6–10 carbons or optionally substituted hetaryl of 5–10 atoms; and $R^5$ represents H, optionally substituted alkyl of 1–10 carbons, optionally substituted aryl of 6–10 carbons or optionally substituted hetaryl of 5–10 atoms;

with the proviso that in formula II, $R^4$ cannot be aryl or hetaryl when Y is O; and with the further proviso that in formula III, $L^2$ cannot be arylene when Y is O.

In the above formulae, a substituted alkyl, aryl or hetaryl group includes such groups substituted with one or more of the following: halogen, cyano, alkyl, aryl, hetaryl, nitro, alkoxy, aryloxy, alkoxy-carbonyl, aryloxy, acylamino, arylsulfonamido, alkylsulfonamido, hydroxy, alkylcarbamoyl, dialkylcarbamoyl, arylcarbamoyl, diarylcarbamoyl, arylalkyl-carbamoyl, alkylureido, arylureido, alkylthio, arylthio, etc.

Dyes according to the above formulae can be prepared by conventional organic chemistry techniques from the corresponding amino or hydroxyl precursors which are disclosed in Japanese Patent Application JP05-212981 and U.S. Pat. No. 4,614,521, the disclosures of which are hereby incorporated by reference.

The receiving element employed in the invention comprises at least one polymer containing a plurality of functional groups of the type:

$$R^2—NH—R^3$$

wherein:

$R^2$ represents substituted or unsubstituted alkyl as described above;

$R^3$ represents H or substituted or unsubstituted alkyl as described above;

$R^2$ and $R^3$ may be joined together to form a 5–7 membered ring; and at least one of $R^2$ and $R^3$ must be attached to the polymer backbone.

It is envisioned that the dye-polymer reaction will lead to polymer bound dyes of the structures below (corresponding to the dye structures I–III above):

$$A-L^1-O-CONR^3R^2 \quad \text{I}$$

$$A-L^2-C(NR^3R^2)=CHCOYR^4 \quad \text{II}$$

$$A-L^2-YCOCH=C(NR^3R^2)R^4 \quad \text{III}$$

where A, $L^1$, $L^2$, Y, $R^2$, $R^3$ and $R^4$ are as described above.

The following dyes may be used in accordance with the invention (Lambda-max values are in acetone solution):

Dye 1

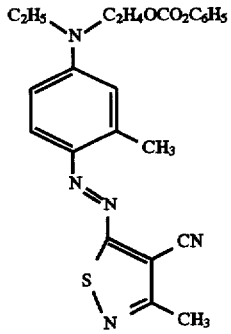

λ-max = 538 nm

Dye 2

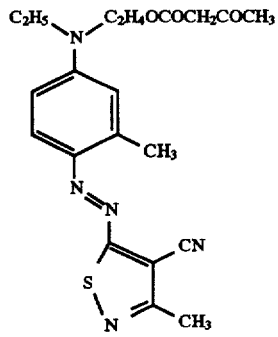

λ-max = 541 nm

-continued

Dye 3

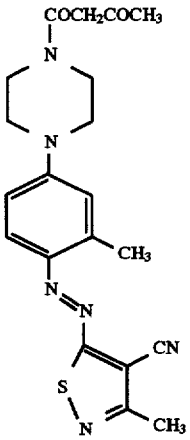

λ-max = 522 nm

Dye 4

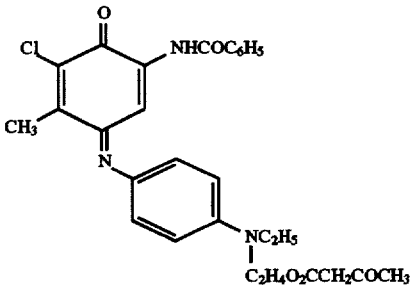

Dye 5

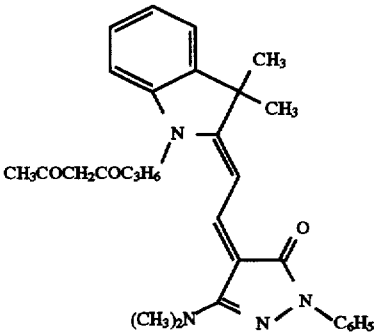

Dye 6

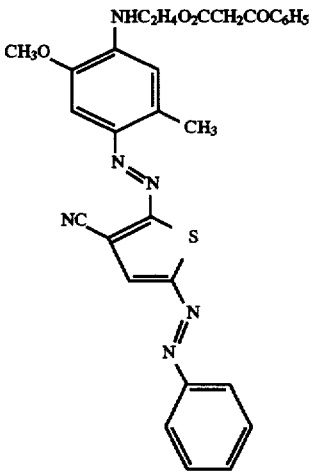

-continued

Dye 7

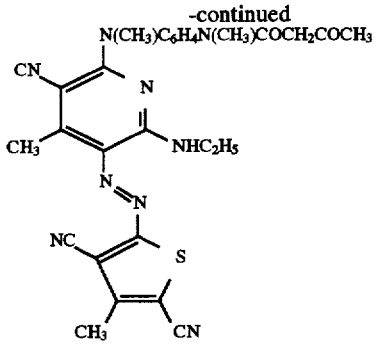

The following receiver polymers may be used in accordance with the invention:

Polymer 1:

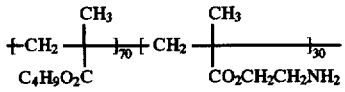

Polymer 2:

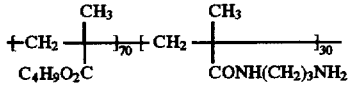

Polymer 3:

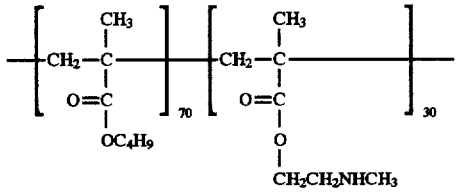

The polymer in the dye image-receiving layer may be present in any amount which is effective for its intended purpose. In general, good results have been obtained at a concentration of from about 0.5 to about 10 g/m$^2$. The above polymers can be prepared by conventional free radical polymerization methods similar to those described in Example 1 of copending U.S. Ser. No. 08/469,248, filed Jun. 6, 1995.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

Resistance to sticking during thermal printing may be enhanced by the addition of release agents to the dye-receiving layer or to an overcoat layer, such as silicone based compounds, as is conventional in the art.

Dye-donor elements that are used with the dye-receiving element of the invention conventionally comprise a support having thereon a dye-containing layer as described above.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of a cyan, magenta and yellow dye, as described above, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following example is provided to further illustrate the invention.

EXAMPLE

The following control dye lacking a reactive carbonyl group was used in the following experiments:

Dye C-1

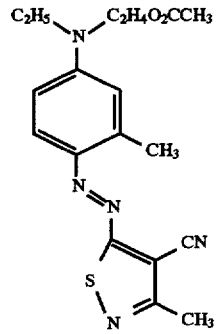

λ-max = 539
(in acetone)

The following control polymers having non-reactive amino groups were used in the following experiments:

Polymer C-1:

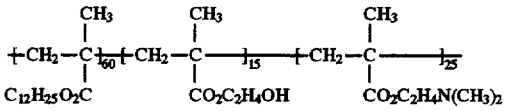

Polymer C-2:

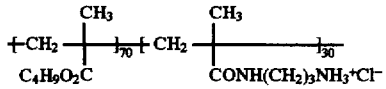

Polymer C-3:

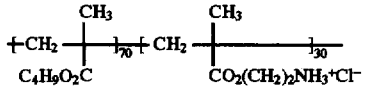

Preparation of Dye-Donor Elements

Dye-donor elements 1–3 and Control Dye-donor elements C-1 were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing dyes 1–3 of the invention and control dye C-1 described above, and FC-431® fluorocarbon surfactant (3M Company) (0.01 g/m$^2$) in a cellulose acetate propionate binder (2.5% acetyl, 45% propionyl) coated from a toluene, methanol and cyclopentanone mixture.

Details of dye and binder laydowns are tabulated in Table 1 below.

On the back side of the dye-donor element was coated:

1) a subbing layer of Tyzor TBT®, a titanium tetrabutoxide, (DuPont Company) (0.16 g/m$^2$) coated from 1-butanol; and 2) a slipping layer of Emralon 329® (Acheson Colloids Co.), a dry film lubricant of poly(tetrafluoroethylene) particles in a cellulose nitrate resin binder (0.54 g/m$^2$) and S-nauba micronized carnauba wax (0.016 g/m$^2$) coated from a n-propyl acetate, toluene, isopropyl alcohol and n-butyl alcohol solvent mixture.

TABLE 1

| Dye Donor Elements | | |
|---|---|---|
| Dye Donor Element Containing Dye | Dye Amount (g/m$^2$) | Binder (CAP) Amount (g/m$^2$) |
| 1 | 0.29 | 0.32 |
| 2 | 0.26 | 0.28 |
| 3 | 0.29 | 0.32 |
| C-1 | 0.24 | 0.26 |

Preparation and Evaluation of Dye-Receiver Elements

Dye-receiver elements according to the invention were prepared by extrusion laminating a paper core with a 38μ thick microvoided composite film (OPPalyte 350TW®, Mobil Chemical Co.) as disclosed in U.S. Pat. No. 5,244,861. The composite film side of the resulting laminate was then coated with the following layers in the order recited:

1) a subbing layer of Polymin Waterfree® polyethyleneimine (BASF, 0.02 g/m$^2$) and 2) a dye receiving layer composed of the polymers described above (3.23 g/m$^2$) and a fluorocarbon surfactant (Fluorad FC-170C®, 3M Corporation, 0.022 g/m$^2$) coated from methanol, except for Polymer C-2 which was coated from 3A alcohol, Polymer C-1 which was coated from 2-butanone and utilized Fluorad FC-431® (3M Corporation, 0.022 g/m$^2$) as surfactant, and Polymer 3 which was coated from methanol and utilized Fluorad FC-431® (3M Corporation, 0.022 g/m$^2$) as surfactant.

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 810625, thermostatted at 31° C.) was pressed with a force of 24.4 newtons (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 μs/pulse) at 129 μs intervals during a 16.9 μs/dot printing cycle. A stepped image density was generated by incrementally increasing the number of pulses/dot from a minimum of 0 to a maximum of 127 pulses/dot. The voltage supplied to the thermal head was approximately 10.25 v resulting in an instantaneous peak power of 0.214 watts/dot and a maximum total energy of 3.48 mJ/dot.

After printing, the dye-donor element was separated from the imaged receiving element and the appropriate (red, green or blue) Status A reflection density of each of the eleven steps in the stepped-image was measured with a reflection densitometer. The maximum reflection density is listed in Table 2.

A second eleven-step image adjusted to yield approximately matched maximum densities (within each set of transfers to a given polymer) of approximately 1–2.5 by varying the printing voltage over the range of 9.25v–12v was prepared as above. The imaged side of the stepped image was place in intimate contact with a similarly sized piece of a poly(vinylchloride) (PVC) report cover, a 1 kg weight was placed on top and the whole assemblage was incubated in an oven held at 50 degrees C. for 1 week. The PVC sheet was separated from the stepped image and the appropriate Status A transmission density in the PVC (a measure of the amount of dye transferred to the PVC) at the highest density step was measured with a transmission densitometer. The results of these measurements are collected in Table 2. In addition the appearance of the stepped image with regard to uniformity and sharpness was noted and given a rating of 0–5. The ratings for these criteria are collected in Table 2. In each case 0 represents no image degradation and 5 represents nearly total image degradation.

TABLE 2

| Dye | Dye Receiver Polymer | Green D-max | Green Transmission Density to PVC | Image Uniformity After Incubtion |
|---|---|---|---|---|
| 1 | 1 | 1.5 | 0.02 | 0 |
| 1 | 3 | 1.7 | 0.03 | 0 |
| 1 | C-1 | 2.3 | 0.54 | 5 |
| 1 | C-2 | 0.7 | 0.34 | 4 |
| 1 | C-3 | 0.7 | 0.45 | 5 |
| 2 | 1 | 1.4 | 0.03 | 0 |
| 2 | 3 | 1.8 | 0.07 | 0 |
| 2 | C-1 | 2.3 | 0.64 | 5 |
| 2 | C-2 | 0.7 | 0.13 | 3 |
| 2 | C-3 | 0.7 | 0.17 | 3 |
| 3 | 1 | 0.8 | 0.02 | 0 |
| 3 | 3 | 0.9 | 0.31 | 5 |
| 3 | C-1 | 1.3 | 0.28 | 5 |
| 3 | C-2 | 0.6 | 0.13 | 4 |
| 3 | C-3 | 0.6 | 0.14 | 4 |
| C-1 | 1 | 1.6 | 0.65 | 5 |
| C-1 | 3 | 2.3 | 0.72 | 5 |
| C-1 | C-1 | 2.9 | 0.29 | 5 |
| C-1 | C-2 | 0.9 | 0.48 | 5 |
| C-1 | C-3 | 1.0 | 0.45 | 5 |

As the above results indicate, the use of dyes substituted with reactive carbonyl groups and dye receiver elements based on polymers containing reactive amino groups yields thermal dye transfer images with good transferred density and superior resistance to image degradation from contact with PVC sheets.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, the dye having a reactive carbonyl group, and (b) a dye-receiving element comprising a support having thereon a dye image-receiving layer, the dye-receiving element being in a superposed relationship with the dye-donor element so that the dye layer is in contact with the dye image-receiving layer, the dye image-receiving layer comprising a polymer containing primary or secondary aliphatic amino groups.

2. The assemblage of claim 1 wherein said dye has the general formulae:

$$A-L^1-OCO_2R^1 \quad \text{I}$$

$$A-L^2-COCH_2COYR^4 \quad \text{II}$$

$$A-L^2-YCOCH_2COR^4 \quad \text{III}$$

wherein:

A represents a thermally transferable dye residue;

$L^1$ represents a divalent alkylene linking group of 1–10 carbon atoms, which may be substituted or interrupted with other divalent moieties;

$L^2$ represents a divalent alkylene linking group of 1–10 carbon atoms, which may be substituted or interrupted with other divalent moieties or an optionally substituted divalent arylene linking group of 6–10 atoms;

$R^1$ represents an optionally substituted aryl group of 6–10 carbons or an optionally substituted hetaryl group of 5–10 atoms;

$R^1$ may optionally be bonded to either A or $L^1$;

Y represents a direct bond, O or $NR^5$;

$R^4$ represents optionally substituted alkyl of 1–10 carbons, optionally substituted aryl of 6–10 carbons or optionally substituted hetaryl of 5–10 atoms; and $R^5$ represents H, optionally substituted alkyl of 1–10 carbons, optionally substituted aryl of 6–10 carbons or optionally substituted hetaryl of 5–10 atoms;

with the proviso that in formula II, $R^4$ cannot be aryl or hetaryl when Y is O; and with the further proviso that in formula III, $L^2$ cannot be arylene when Y is O.

3. The assemblage of claim 2 wherein A is the residue of an azo dye, an indoaniline dye or a merocyanine dye.

4. The assemblage of claim 2 wherein $L^1$ or $L^2$ is an alkylene group of from 2 to 4 carbon atoms.

5. The assemblage of claim 2 wherein $R^1$ is hydrogen.

6. The assemblage of claim 1 wherein said dye-image-receiving layer polymer contains a plurality of functional groups of the type:

$$R^2-NH-R^3$$

wherein:

$R^2$ represents substituted or unsubstituted alkyl;

$R^3$ represents H or substituted or unsubstituted alkyl;

$R^2$ and $R^3$ may be joined together to form a 5–7 membered ring; and at least one of $R^2$ and $R^3$ must be attached to the polymer backbone.

7. A process of forming a dye transfer image comprising imagewise-heating a dye-donor element comprising a support having thereon a dye layer comprising a dye dispersed in a polymeric binder, said dye having a reactive carbonyl group, and imagewise transferring said dye to a dye-receiving element to form said dye transfer image, said dye-receiving element comprising a support having thereon a dye image-receiving layer, said dye image-receiving layer comprising a polymer containing a primary or secondary aliphatic amino group.

8. The process of claim 7 wherein said dye has the general formulae:

$$A-L^1-OCO_2R^1 \quad \text{I}$$

$$A-L^2-COCH_2COYR^4 \quad \text{II}$$

$$A-L^2-YCOCH_2COR^4 \quad \text{III}$$

wherein:

A represents a thermally transferable dye residue;

$L^1$ represents a divalent alkylene linking group of 1–10 carbon atoms, which may be substituted or interrupted with other divalent moieties;

$L^2$ represents a divalent alkylene linking group of 1–10 carbon atoms, which may be substituted or interrupted with other divalent moieties or an optionally substituted divalent arylene linking group of 6–10 atoms;

$R^1$ represents an optionally substituted aryl group of 6–10 carbons or an optionally substituted hetaryl group of 5–10 atoms;

$R^1$ may optionally be bonded to either A or $L^1$;

Y represents a direct bond, O or $NR^5$;

$R^4$ represents optionally substituted alkyl of 1–10 carbons, optionally substituted aryl of 6–10 carbons or optionally substituted hetaryl of 5–10 atoms; and $R^5$ represents H, optionally substituted alkyl of 1–10 carbons, optionally substituted aryl of 6–10 carbons or optionally substituted hetaryl of 5–10 atoms;

with the proviso that in formula II, $R^4$ cannot be aryl or hetaryl when Y is O; and with the further proviso that in formula III, $L^2$ cannot be arylene when Y is O.

9. The process of claim 8 wherein A is the residue of an azo dye, an indoaniline dye or a merocyanine dye.

10. The process of claim 8 wherein $L^1$ or $L^2$ is an alkylene group of from 2 to 4 carbon atoms.

11. The process of claim 8 wherein $R^1$ is hydrogen.

12. The process of claim 7 wherein said dye-image-receiving layer polymer contains a plurality of functional groups of the type:

$$R^2—NH—R^3$$

wherein:

$R^2$ represents substituted or unsubstituted alkyl;

$R^3$ represents H or substituted or unsubstituted alkyl;

$R^2$ and $R^3$ may be joined together to form a 5–7 membered ring; and at least one of $R^2$ and $R^3$ must be attached to the polymer backbone.

* * * * *